United States Patent [19]

Reinwald et al.

[11] 4,118,189

[45] Oct. 3, 1978

[54] METHOD OF WASHING TEXTILES

[75] Inventors: Elmar Reinwald, Dusseldorf-Holthausen; Milan Johann Schwuger, Haan, both of Germany

[73] Assignee: Henkel Kommanditgesellschaft auf Aktien, Dusseldorf-Holthausen, Fed. Rep. of Germany

[21] Appl. No.: 700,864

[22] Filed: Jun. 29, 1976

[30] Foreign Application Priority Data

Jul. 2, 1975 [AT] Austria ..... 5088/75

[51] Int. Cl.[2] ..... B08B 3/00

[52] U.S. Cl. ..... 8/137

[58] Field of Search ..... 8/137; 134/22; 252/307

[56] References Cited

U.S. PATENT DOCUMENTS

| | | | |
|---|---|---|---|
| 1,948,568 | 2/1934 | Faber et al. | 252/307 |
| 3,037,887 | 6/1962 | Brenner et al. | 134/22 R |
| 3,994,682 | 11/1976 | Braun et al. | 8/137 |

*Primary Examiner*—William E. Schulz
*Attorney, Agent, or Firm*—Hammond & Littell

[57] ABSTRACT

An improved method for washing textiles comprising contacting soiled textiles with a foamed detergent solution, said solution containing from 10 to 5o gm per liter of a cleaning composition containing at least some nonionic surface-active compounds, and being employed in a liquor ratio of 1:1 to 1:5, said detergent solution being foamed by air to a liter weight of 5 to 30 gm before contacting said soiled textiles, agitating said soiled textiles in the presence of said foamed detergent solution for at least 30 seconds, spinning off said foamed detergent solution under sufficient force to break said foam, and to extract said detergent solution, repeating the above steps at least five times, then rinsing said textiles and recovering cleaned textiles.

10 Claims, 3 Drawing Figures

METHOD OF WASHING TEXTILES

THE RELATED ART

The washing action of an aqueous detergent solution increases, as known, with an increased concentration of cleansing substances. Disregarding the possibility of an uneconomical and environment polluting overdose, it has therefore been suggested to reduce the amount of the wash water with a constant amount of detergent in the so-called main or clear wash cycle. However, going below a liquor ratio, that is, a ratio of the textile material (in kg) to the wash liquor (in liters) of about 1:5 to 1:4 is either not possible or possible only under special conditions. With these low liquor ratios, the necessary exchange of cleaning substances and soil is no longer ensured due to insufficient wetting of the textile material, or in the case of automatic washing machines, the heat exchange between the heating elements and the wash liquor and textile material is no longer adequately controlled. It was also found that the dirt, which was detached from the textile material and dispersed in the relatively highly concentrated detergent solution, is partially deposited again on the fiber during the subsequent rinsing, due to a dilution of the wash liquor.

One of the suggested solutions is to impregnate balls or other molded articles of porous foam with highly concentrated detergent solutions and to let them act under constant stirring on the textile material to be cleaned if necessary, with addition of some water. The detergent is transferred here to the textile material and a part of the soil is absorbed by the porous material introduced. The remaining soil and the detergent adhering to the textile material are not removed. This method does not meet the requirements of economical material consumption, simple handling and a uniform, high quality washing result.

OBJECTS OF THE INVENTION

An object of the present invention is the development of a washing method which permits the use of high detergent concentrations with a corresponding high quality washing result, while saving water both in the main wash cycle and in the rinse cycle, and as a result therefore saving heating energy.

Another object of the present invention is the development of a method for the washing of textiles comprising (1) contacting soiled textiles with a foamed detergent solution, said detergent solution containing from 10 to 50 gm per liter of a cleaning composition and being employed in a liquor ratio of from 1:1 to 1:5, wherein said cleaning composition comprises (a) from 5% to 100% by weight of foamable surface-active compounds, where from 10% to 100% by weight of the foamable surface-active compounds are polyglycol ether non-ionic surface-active compounds and (b) from 0 to 95% by weight of builder salts and cleansing composition additives, said detergent solution being foamed by air to a liter weight of 5 to 30 gm before contacting said soiled textiles, (2) agitating said soiled textiles in the presence of said foamed detergent solution for at least 30 seconds, (3) separating said foamed detergent solution from said textiles under sufficient force whereby the foam is broken and the detergent solution is recovered as a liquor, (4) foaming said recovered detergent solution with air, (5) repeating steps (1) to (4) from five to 50 times, (6) then rinsing said textiles, and (7) recovering cleansed textiles.

These and other objects of the invention will become more apparent as the description thereof proceeds.

THE DRAWINGS

FIG. 1 shows a schematic view of a device for practicing the process of the invention.

FIG. 2 is a cross-section of one embodiment of a washing machine for the practice of the process of the invention.

FIG. 3 is a cross-section of another embodiment.

DESCRIPTION OF THE INVENTION

The subject matter of the invention is a method for washing textiles, using an aqueous foamable detergent solution, which is characterized in that the detergent solution contains from 10 to 50 gm of a cleansing composition per liter and is employed in an amount where the liquor ratio of textile material (in kg) to detergent solution (in liters) is 1:1 to 1:5, where the cleansing composition has the following composition:

(a) 5% to 100% by weight of foamable surface-active compounds, of which in turn 10% to 100% by weight of these foamable surface-active compounds are at least one non-ionic surface-active compound from the class of the polyglycol ether derivatives, and (b) 0 to 90% by weight of builder salts and other known detergent additives, that the detergent solution, without coming directly in contact with the textile material, is transformed into foam by the introduction of air at a temperature of 20° C. to 95° C., with a weight per liter of 5 to 30 gm, that the foam is fed through a line continuously or intermittently to the textile material and the latter is mechanically agitated, that the foam is removed after a period of 30 seconds to about 15 minutes by spinning, that the operations of feeding the foam, acting on the textile material by mechanical treatment, and spinning off the foam with return of the wash liquid are repeated five to fifty times, and that the textile material is rinsed in known manner after the last spinning of the foam and removal of the detergent solution.

In a special embodiment, the method permits the use of low-phosphate or phosphate-free detergents without the necessity of adding corresponding amounts of phosphate substitutes.

More particularly, therefore, the present invention relates to a method for the washing of textiles comprising (1) contacting soiled textiles with a foamed detergent solution, said detergent solution containing from 10 to 50 gm per liter of a cleaning composition and being employed in a liquor ratio of from 1:1 to 1:5, wherein said cleaning composition comprises (a) from 5% to 100% by weight of foamable surface-active compounds, where from 10% to 100% by weight of the foamable surface-active compounds are polyglycol ether non-ionic surface-active compounds and (b) from 0 to 95% by weight of builder salts and cleansing composition additives, said detergent solution being foamed by air to a liter weight of 5 to 30 gm before contacting said soiled textiles, (2) agitating said soiled textiles in the presence of said foamed detergent solution for at least 30 seconds, (3) separating said foamed detergent solution from said textiles under sufficient force whereby the foam is broken and the detergent solution is recovered as a liquor, (4) foaming said recovered detergent solution with air, (5) repeating steps (1) to (4) from five to fifty times, (6) then rinsing said textiles, and (7) recovering cleansed textiles.

The method according to the invention can be carried out in a conventional drum-type washing machine, where the outer drum, the so-called liquor tank, contains the detergent solution in contact with heating elements, and the perforated inner drum is arranged rotatably therein and receives the textile material. The amount of the wash liquor is so selected that it does not come in direct contact with the textile material during the washing process, that is, that the level of the detergent solution in the suggested arrangement does not reach into the interior of the inner drum, even after the foam liquid has been spun off.

The foam is applied by means of a feeding system directly on the textile material. Such a device consists of a line connected with the bottom of the liquor tank and leading into the inner drum, where fresh air is introduced in the rising part of the line through a nozzle or frit provided with one or several orifices and arranged below the liquid level. The foam rising in the uptake enters the inner drum which is rotating slowly and spreads uniformly over the moving material to be washed. During the following wash cycle, the wash is moved mechanically or circulated, so that a thorough exchange takes place with the foam. After a period of about 30 seconds to 15 minutes, preferably 1 to 10 minutes, the foam is destroyed by brief spinning and the soil-laden detergent solution absorbed by the textile material or formed by the decomposition of the foam, is partly removed again and returned into the liquor tank.

This solution is then foamed again, the wash is treated mechanically in the presence of the foam and spun, and the cycles are repeated until the desired cleansing result is obtained. Depending on the degree of soiling of the wash and the effectiveness of the detergent, this requires 5 to 50, preferably 10 to 30 cycles. This way a directed fluid transport is obtained, which leads to a high quality washing result, despite the small amounts of liquid used. In addition, a filter or a settling tank can be provided between the liquor tank and the aerated riser, with which coarse soil particles are removed from the circuit. This prevents the textile material from being soiled again by soil particles or lint which have already been detached.

The mechanical treatment of the wash during the foam treatment serves primarily to obtain a uniform distribution of the supplied foam. It can be temporarily interrupted or it can be carried out so gently that a certain foam cushion is maintained and excessive mechanical stress on the wash by vigorous beating or circulation is avoided. This protects the wash further. The destruction of the foam and partial removal of the wash liquid released by the destruction of the foam which is carried out repeatedly during the washing, requires only relatively minor centrifugal forces. In general, a centrifugal force which is about five times to twenty times the amount of the acceleration due to gravity is completely sufficient for the intermittent spinning. To this end the conventional drum-type washing machine with a drum diameter of about 35 to 80 cm and spinning speeds of about 60 to 400 rpm are quite adequate. The last spinning of the foam or foam liquid effected after the completion of the main wash cycle can be effected under the same conditions as in the intermittent spinning. However, it is advisable to aim at extensive draining of the wash by increasing the speed, so that the content of the wash liquor remaining in the washed textile material does not exceed 0.5 to 1 liter/kg of textile material. The wash liquid accumulating in the liquor tank after this final spinning is drained or pumped off before the first rinsing water is added.

The washing process can also be carried out in several, preferably two steps, replacing the wash liquid in between. This method is recommended particularly for greatly soiled wash. The first stage, the so-called prewash cycle, can be carried out in known manner both with foam according to the invention and without foam, that is, with a higher liquor level, a liquor ratio of 1:5 to 1:20, a detergent concentration of 1 to 5 gm/liter, as well as a washing temperature of 15° C. to 40° C. Such a prewash cycle serves primarily to remove coarse soil, particularly mineral soil, which could interfere with the main wash cycle. The prewash liquor is removed before the start of the main wash cycle, if necessary, with moderate intermediate spinning of the textile material.

For less soiled textile material or for material only soiled with fats, as is the case in underwear or tablecloths and napkins, a single main or clear liquid wash cycle carried out according to the invention is sufficient. The liquor ratio is reduced in the main wash cycle, compared to a conventional washing process, and is 1:1 to 1:5. The detergent concentration is increased, compared to a conventional washing process, and is 10 to 50 gm/liter.

The washing temperature is 20° to about 95° C., preferably 30° to 70° C. Particularly with highly foaming anionic surfactants, an uncontrolled formation of foam may be observed at temperatures over 90° C., so that the temperature is preferably reduced in these cases. As far as the surface-active compounds employed are primarily or entirely of a non-ionic nature, the temperature should be preferably below or in the range of the turbidity point of the non-ionic surface-active compounds or tensides in the interest of a good foam development.

The method according to the invention is carried out by using conventional cleansing compositions, which include particularly tensides or surface-active compounds, and possibly builder salts, consisting of sequestering or alkaline-reacting inorganic or organic salts, as well as other conventional detergent additives. Other suitable additives are bleaching agents, bleaching activators, as well as stabilizers for percompounds, soil suspension agents, optical brighteners, enzymes, neutral salts, brightening substances, biocides, as well as dyes and perfumes.

Suitable tensides are anionic surface-active compounds such as those of the sulfonate or sulfate type, for example, alkylbenzene sulfonates, particularly n-dodecylbenzene sulfonates, olefin sulfonates, alkyl sulfonates and α-sulfo fatty acid esters, primary and secondary alkylsulfates as well as sulfates of ethoxylated or propoxylated higher molecular weight alcohols. Suitable also are the sulfated partial higher alkyl ethers and partial higher fatty acid esters of polyhydric alcohols, such as the alkali metal salts of the monoalkyl ethers or monofatty acid esters of glycerin monosulfuric acid ester, or 1,2-dihydroxypropane sulfonic acid. Furthermore, sulfates of ethoxylated or propoxylated fatty acid amides and alkylphenols as well as fatty acid taurides and fatty acid isothionates can also be used.

Other suitable anionic surface-active compounds for incorporation in detergents are the alkali metal soaps of fatty acids of natural or synthetic origin, e.g., the sodium soaps of coconut fatty acids, palm oil fatty acids, or tallow fatty acids. Zwitterionic surface-active compounds are also suitable tensides for incorporation in the detergents of the invention, such as alkyl betaines and particularly alkyl sulfobetaines, e.g., 3-(N,N-dimethyl-N-alkyl-ammonium)-propane-1-sulfonate and 3-(N,N-dimethyl-N-alkylammonium)-2-hydroxypropane-1-sulfonate, where the alkyl contains from 8 to 18 carbon atoms.

The anionic surface-active compounds can be present in the form of the alkali metal salts, such as sodium or potassium, the ammonium salts, and, as well, salts of organic bases, particularly alkylamines having 1 to 3 carbon atoms in the alkyls and alkylolamines having 2 to 3 carbon atoms in the alkylol, such as mono- or triethanolamine. As far as the above-mentioned anionic and Zwitterionic surface-active compounds have an aliphatic hydrocarbon radical, the latter should be preferably straight-chained and having 8 to 22 carbon atoms. In the compounds with an araliphatic hydrocarbon radical the preferably unbranched alkyl chains contain on the average 5 to 16 carbon atoms attached preferably to the phenyl group.

The foamable surface-active compounds in the detergent consist preferably of 10% to 100%, particularly 50% to 100%, by weight of non-ionic surface-active compounds from the class of polyoxyalkylene glycol ether derivatives, preferably derivatives of alkanols or alkenols with 10 to 24 carbon atoms and/or alkylphenols with 6 to 15 carbon atoms in the alkyl chain, having from 3 to 30 glycol ether groups. Preferably the polyoxyalkylene glycol ethers are adducts of ethylene oxide. However, small amounts up to 35% by weight of other alkylene oxides having 2 to 4 carbon atoms, such as propylene oxide or butylene oxide may be used. Particularly suitable are mixtures of these polyglycol ether derivatives, where at least one compound has 3 to 6 ethylene oxide units and at least one compound has 7 to 20 ethylene oxide units in a weight ratio of 5:1 to 1:10. Polyglycol ether derivatives of straight-chained primary alkenols with 12 to 18 carbon atoms and of alkylphenols with straight-chained alkyl chains having 8 to 12 carbon atoms are preferred.

Other suitable non-ionic surface-active compounds suitable for incorporation in the detergents are polyglycol ether derivatives of higher fatty acids, higher fatty acid amides, primary or secondary higher fatty alkyl amines, vicinal higher alkylene diols, higher alkyl thioalcohols and higher alkyl sulfamides which have 10 to 24 carbon atoms in the hydrocarbon radical and 3 to 30 polyglycol ether groups, preferably as described above. Non-ionic compounds of the type of the aminoxides and sulfoxides, which can also be ethoxylated, are likewise suitable.

Suitable builder salts are the carbonates and silicates of the alkali metals such as potassium, and particularly sodium, Preferably the sodium silicates have a ratio of $SiO_2$ to $Na_2O$ of 1:1 to 3.5:1. Sequestering builder salts can also be employed such as the alkali metal salts of the polymeric phosphates, particularly pentasodium tripolyphosphate, which can be present in mixture with its hydrolysis products, the mono- and dipolyphosphates, as well as of the higher polymeric phosphates, e.g., the tetrapolyphosphates.

The polymeric phosphates can also be replaced partly or completely by phosphate-free sequestering agents. These comprise the alkali metal salts of aminopolylower alkyl carboxylic acids, particularly nitrilotriacetic acid and ethylene diaminotetraacetic acid. Also suitable are the alkali metal salts of diethylene triaminopentaacetic acid, as well as the higher homologs of the above-mentioned amino-polycarboxylic acids. Other suitable amino-polycarboxylic acids are poly-(n-succinic acid)-ethyleneimine, poly-(N-tricarballic acid)-ethylene-imine, and poly-(N-butane-2,3,4-tricarboxylic acid)-ethyleneimine. Instead of the salts of amino-polycarboxylic acids or in admixtures with the latter, the alkali metal salts of the sequestering polyphosphonic acids can be employed, particularly aminotri-(methylene phosphonic acid), 1-hydroxyethane-1,1-diphosphonic acid, methylene diphosphonic acid, ethylene diphosphonic acid, as well as salts of the higher homologs of the above-mentioned polyphosphonic acids.

Of particular importance as sequestering builder salts are the nitrogen and phosphorus free polycarboxylic acids foaming complex salts with calcium ions, which also include polymers containing carboxyl groups. Suitable are the polycarboxylic acids having 4 to 20 carbon atoms, such as citric acid, tartaric acid, benzene hexacarboxylic acid and tetrahydrofuran tetracarboxylic acid. Polycarboxylic acids having 4 to 20 carbon atoms and containing carboxy-methyl ether groups are also suitable, such as 2,2'-oxy-disuccinic acid, as well as polyhydric alcohols or hydroxy-carboxylic acids, partly or completely etherified with glycolic acid, such as triscarboxymethyl glycerin, bis-carboxymethyl glyceric acid, and carboxymethylated or oxidized polysaccharides. Furthermore, the polymeric carboxylic acids with a molecular weight of at least 350 in the form of the water-soluble sodium or potassium salts are also suitable, such as polyacrylic acid, polymethacrylic acid, poly-$\alpha$-hydroxyacrylic acid, polymaleic acid, polyitaconic acid, polymesaconic acid, polybutene tricarboxylic acid as well as the copolymers of the corresponding monomeric carboxylic acids with each other or with ethylenically unsaturated compounds, like ethylene, propylene, isobutylene, vinylmethyl ether or furan.

Additional mixture components or cleansing composition additives are those customarily employed in detergents. Among these are the oxygen-supplying bleaching agents, like alkali metal perborates, alkali metal percarbonates, alkali metal perpyrophosphates and alkali metal persilicates, as well as urea perhydrate. Preferred is sodium perborate-tetrahydrate. For stabilizing the percompounds, the detergents can contain magnesium silicate, for example, in amounts of 3% to 20% by weight, related to the amount of perborate. Detergents to be used for textiles at temperatures below 70° C., so-called cold water detergents, can contain bleaching activators, particularly tetraacetylglycoluril or tetraacetyl ethylene diamine as a powder component. The powder particles consisting of the bleach activator or of the percompound can be coated with enveloping substances, like water-soluble polymers or fatty acids, to avoid interaction between the percompound and the activator in storage.

The detergents can also contain optical brighteners, particularly derivatives of diaminostilbenedisulfonic acid or its alkali metal salts. Suitable, for example, are alkali metal salts of 4,4'-bis-(2''-anilino-4''-morpholino-1,3,5-triazinyl-6''-amino)-stilbene-2,2'-disulfonic acid or similarly constituted compounds which carry a diethanol-amino group, a methylamino group or a $\beta$-methoxyethylamino group instead of the morpholino group. Optical brighteners for polyamide fibers which can also be used as those of the type of the diarylpyrazolines, for example, 1-(p-sulfonamido-phenyl)-3-(p-chlorophenyl)-$\Delta^2$-pyrazoline, as well as similarly constituted compounds which carry a carboxymethyl or acetylamino group instead of the sulfonamido group. Also suitable as optical brighteners are the substituted aminocumarins, for example, 4-methyl-7-dimethylcumarin or 4-methyl-7-diethylamino-cumarin. The compounds 1-(2-benzimidazolyl)-2-(1-hydroxyethyl-2-benzimidazolyl)-ethylene and 1-ethyl-3-phenyl-7-diethylamino-carbostyril can also be used as polyamide optical brighteners. Suitable as optical brighteners for polyester and polyamide fibers are the compounds 2,5-di-(2-benzoxazolyl)-thiophene, 2-(2-benzoxazolyl)-naphtho-[2,3-b]-thiophene and 1,2-di-(5-methyl-2-benzoxazolyl)-ethylene. Furthermore, optical brighteners of the type of the substituted diphenylstyrils can also be present. Mixtures of the above-mentioned brighteners can also be used.

Greying inhibitors or soil suspension agents can also be incorporated, such as carboxymethyl cellulose, methyl cellulose, also water-soluble polyesters or polyamides from polyvalent carboxylic acids and glycols or diamines, which contain free carboxyl groups, betaine groups, or sulfobetaine groups capable of forming salts, as well as colloidal water-soluble polymers or copolymers of vinyl alcohol, vinyl pyrrolidone, acrylamide and acrylonitrile.

The detergents can also contain enzymes from the class of the proteases, lipases and amylases or mixtures thereof. Particularly suitable are enzymatic active substances obtained from bacterial strains or fungi, such as Bacillus subtilis, Bacillus licheniformis and Streptomyces griseus.

As additional components for the detergents, neutral salts can be incorporated, particularly sodium sulfate, as well as biocides, like halogenated diphenylmethanes, salicyl anilides, carbanilide and phenol. Liquid detergents can also contain hydrotropic substances and solvents, like the alkali metal salts of benzenesulfonic acid, toluenesulfonic acid, or xylenesulfonic acid, urea, glycerin, polyglycerin, di- or trioxyethylene glycol, polyoxyethylene glycol, ethanol, i-propanol and ether alcohols.

If necessary, known foam stabilizers, like higher fatty acid alkanolamides, can also be present, for example, lauryl mono- or diethanolamide or coconut fatty acid, mono- or diisopropanolamide.

After the washing is completed, the liquid foam is spun off and the liquor tank is emptied. The textile material is then rinsed with clear water to remove the adhering wash liquid. This requires less water and/or fewer rinsing cycles than in a conventional washing process. In general, two rinse cycles in between which the water is drained and an amount of water which is, expressed in liters, 5 to 10 times the weight of the textiles, expressed in kg, are sufficient. The consumption of heating energy is also much lower than in a conventional washing process, since only a relatively small amount of wash liquid has to be heated. Despite these advantageous savings, the washing result is equivalent or superior to a conventional washing process.

Another advantage of the method according to the invention is that, due to the use of a highly concentrated wash liquid, particularly in the presence of higher contents of non-ionic surface-active compounds, the use of phosphates can be partly or even completely eliminated.

DESCRIPTION OF THE DRAWINGS

A suitable device for carrying out the washing method according to the invention consists substantially, as can be seen from FIG. 1, of a washing machine with an enclosed liquor tank 1, a perforated rotating inner drum 2 arranged in the liquor tank and charged with the textile material, which is secured on a rotatable motor driven shaft 3 and which has the following characterizing features: a line 4 connected to the bottom of the liquor tank 1, which leads into the interior of the inner drum 2 by outlet 13 and into which air is forced by means of an air pump 5 through a feed line 6 and a nozzle or frit 7 arranged under the liquid level and provided with one or more outlet orifices.

In FIG. 2, the liquor tank 1 is accessible from the top by means of a cover 8 and the inner drum 2 has a lid 9 which is inserted in the cylindrical outer shell. The liquor tank 1 is connected to the drain sleeve 10 for the spent wash liquor and to the line 4, which leads to a filter 11 and then to the foamer nozzle or frit 7 and to the hollow drive shaft 3 which has an outlet 13 open toward the inner drum, or which is integrated with the latter. FIG. 3 shows an arrangement where the inner drum is accessible through a screw cap 12 articulated laterally on the liquor tank. The feed line 4 for the foam is arranged in this case in the screw cap or is integrated with the latter to lead to the outlet 13. In FIGS. 2 and 3 the space occupied by the wash liquid is hatched, that occupied by the foam in line 4 is dotted.

Figure 2:
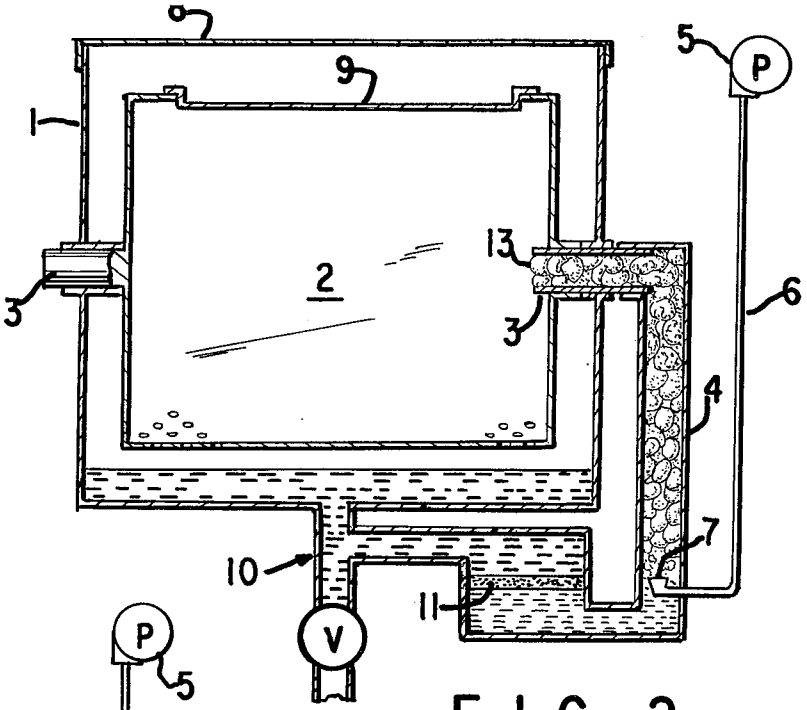
FIGS. 2 and 3 show embodiments which have proved themselves in practice.
Figure 1:
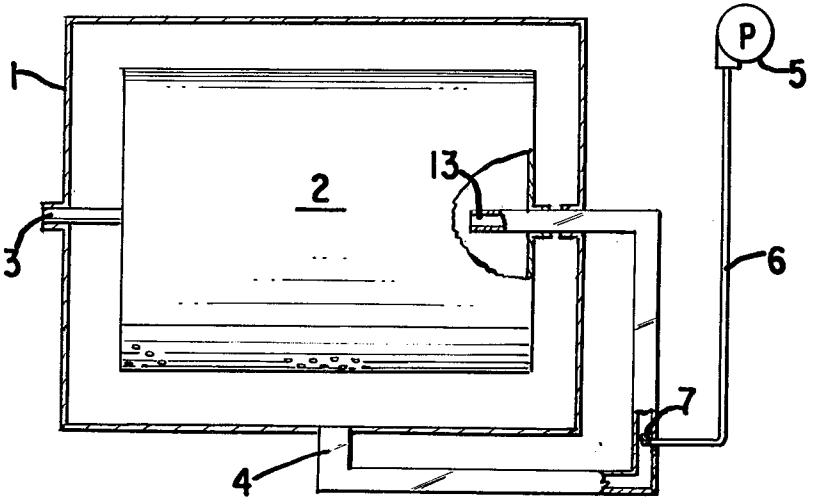

Instead of the represented arrangement, arrangements with an inclined or vertical rotating drum could be utilized, in which case the foam is conducted into the drum from the top.

The following examples are illustrative of the practice of the invention without being limitative in any respect.

EXAMPLES

In the following, examples of detergent formulas which were used in the washing tests are given. EO stands for added ethylene oxide and the number gives the amount added in mols. The percentages are percent by weight.

EXAMPLE 1

70% Tallow fatty alcohol + 12 EO
30% Tallow fatty alcohol + 5 EO

EXAMPLE 2

30% Tallow fatty alcohol + 14 EO
40% Nonylphenol + 10 EO
30% Tallow fatty alcohol + 5 EO

EXAMPLE 3

20% Tallow fatty alcohol + 10 EO
10% Tallow fatty alcohol + 5 EO
25% Sodium tripolyphosphate
21% Sodium perborate
10% Sodium silicate ($Na_2O : SiO_2 = 1:3.3$)
Balance sodium sulfate

EXAMPLE 4

10% Nonylphenol + 10 EO
30% Sodium tripolyphosphate
20% Sodium perborate-tetrahydrate 5% Tetraacetylglycoluril
1% Na-ethyleneaaminotetraacetate
1.5% Na-carboxymethylcellulose
Balance sodium sulfate

EXAMPLE 5

5% Nonylphenol + 10 EO
5% Tallow fatty alcohol +10 EO
50% Sodium tripolyphosphate
20% Sodium perborate-tetrahydrate
5% Tetraacetylglycoluril
1.5% Na-carboxymethylcellulose
Balance sodium sulfate

EXAMPLE 6

15% Tallow fatty alcohol + 10 EO
40% Sodium tripolyphosphate
20% Sodium percarbonate
5% Tetraacetylglycoluril
1.5% Na-carboxymethylcellulose
Balance sodium sulfate

EXAMPLE 7

22.8% Tallow fatty alcohol + 10 EO
12.3% Tallow fatty alcohol + 5 EO
35.1% Sodium tripolyphosphate
21.0% Sodium perborate
8.8% Sodium silicate ($Na_2O : SiO_2 = 1:3.3$)

EXAMPLE 8

6.4% Coconut fatty alcohol + 2 EO-sulfate (Na salt)
7.0% Tallow fatty alcohol + 14 EO
35.0% Sodium tripolyphosphate
0.2% Na-ethylenediaminotetraacetate
5.0% Sodium silicate (1:3.3)
20.0% Sodium perborate
1.4% Na-carboxymethylcellulose
2.0% Mg silicate
10.5% Sodium sulfate
Balance water

EXAMPLE 9

5.0% Na-n-dodecylbenzene sulfonate
2.5% Coconut fatty alcohol + 7 EO
2.5% Tallow fatty alcohol + 12 EO
20.0% Sodium tripolyphosphate
10.0% Na-nitrilotriacetate
5.0% Sodium carbonate
3.0% Sodium silicate (1:3.3)
26.5% Sodium perborate
1.4% Na-carboxymethylcellulose
2.0% Mg silicate
10.5% Sodium sulfate
Balance water.

Figure 3:
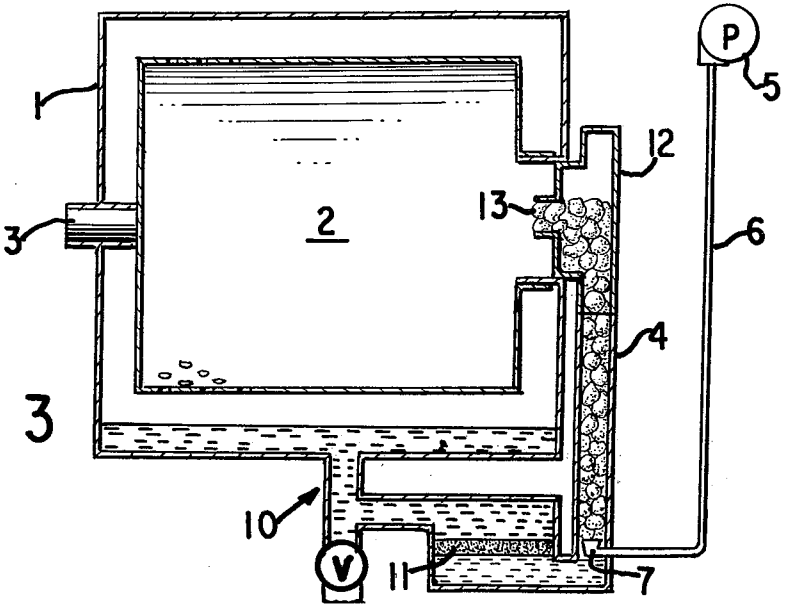

The washing tests were carried out in a washing machine according to FIG. 2 (1st test series) and according to FIG. 3 (2nd test series). In both cases the inner drum had a maximum capacity of 4 kg dry wash, with a diameter of about 50 cm and was provided with longitudinal ribs for the mechanical agitation of the textile material. Before the circulated wash liquid was foamed, it was passed through a filter 11 which contained a glass frit as a filter insert and was charged additionally with a filter aid (fine-grained kieselguhr, trademark "Celite"). The compressed air generated by a regulable diaphragm pump 5 was conducted over a fine-pored glass frit 7 in the rising part of pipe line 4.

After the inner drum had been charged with the textile material and the wash liquid had been heated to the desired washing temperature, the production of foam was started by introducing air and it was not stopped during the entire washing period. Five liters of foam with a density of 10 gm/liter were produced per minute. The drum 2 turned five times in one direction during 5 seconds. After a rest period of 10 seconds, the movement was reversed. After a wash cycle of 3 minutes each (1st test series) and 6 minutes each (2nd test series), the foam was spun off within 15 seconds at a speed of the drum of 300 rpm. Thereafter the wash cycle was repeated. The entire washing process was one hour or about 20 cycles for the 1st test series and about 10 cycles for the 2nd test series. After the washing process was completed, the wash liquid was drained off to a great extent through a drain valve by spinning at 300 rpm per minute. Subsequently the textile material was rinsed with cold tapwater, and the result could be checked by a foam test. To this end air was introduced over the frit into the riser. When foam failed to appear in the rinse water, the rinsing process was successfully completed.

The material to be washed consisted of 2.5 kg of a complete wash (slightly soiled cotton goods) as well as test patches of cotton (abbreviation "*c*"), wash-and-wear finished cotton (abbreviation "f.c") and blends of polyester and finished cotton (abbreviation "p.f.c."), with the dimensions 10 × 20 cm, all soiled under standardized condition (so-called Krefelder test soiling). The water hardness was 16° German hardness. The other washing conditions, such as concentration of the wash liquor, liquor ratio, temperature, etc., can be seen from the Table. The washing result was identical in both test series within the error limits (washing rhythm 3 minutes and 6 minutes, respectively). The mean value of the remission obtained was determined from five photometric individual measurements. For comparison we tested in the same machine, without the production of foam, a modern heavy-duty detergent given reference number 10 under the usual washing conditions. While in the washing tests according to the invention, three rinse cycles with 10 liters of water each were sufficient, four rinse cycles with 20 liters of water each were required in the comparison tests. The results show clearly the superiority of the washing method according to the invention.

COMPARISON 10

7,5% Na-N-dodecylbenzene sulfonate
2,2% Tallow fatty alkohol + 10 EO
40,0% Sodium tripolyphosphate
3,0% Sodium silicate ($Na_2O : SiO_2 = 1:3,3$)
25,0% Sodium perborate
0,2% Na-ethylenediaminotetraacetate
1,4% Na-carboxymethylcellulose
2,0% Mg-silicate
10,8% Sodium sulfate
Balance water

TABLE

| Example | Formula No. | Wash solution liters | Conc. gm per liter | Liquor ratio | Temp. ° C | Time hrs. | % Remission c. | f.c. | p.f.c. |
|---|---|---|---|---|---|---|---|---|---|
| Comparison | 10 | 12.5 | 5 | 1:5 | 60 | 1 | 69 | 56 | 52 |
| 1 | 1 | 5 | 10 | 1:2 | 60 | 1 | — | 74 | 72 |
| 2 | 2 | 5 | 10 | 1:2 | 60 | 1 | — | 76 | 73 |
| 3 | 3 | 5 | 10 | 1:2 | 60 | 1 | 80 | 78 | 73 |
| 4 | 4 | 3 | 15 | 1:1.2 | 60 | 1 | 77 | 67 | 65 |
| 5 | 5 | 3 | 15 | 1:1.2 | 60 | 1 | 79 | 67 | 65 |
| 6 | 6 | 3 | 15 | 1:1.2 | 60 | 1 | 79 | 68 | 66 |
| 7 | 7 | 3 | 15 | 1:1.2 | 60 | 1 | 79 | 70 | 68 |
| 8 | 8 | 3 | 15 | 1:1.2 | 60 | 1 | 79 | 69 | 66 |
| 9 | 9 | 3 | 15 | 1:1.2 | 60 | 1 | 78 | 68 | 65 |

The preceding specific embodiments illustrate the practice of the invention. It is to be understood, however, that other expedients known to those skilled in the art or disclosed herein may be employed without departing from the spirit of the invention or the scope of the appended claims.

We claim:

1. A method for the washing of textiles comprising (1) contacting soiled textiles with a foamed detergent solution, said detergent solution being maintained at a temperature of from 30° C. to 70° C. and containing from 10 to 50 gm per liter of a cleaning composition and being employed in a liquor ratio of from 1:1 to 1:5, wherein said cleaning composition comprises (a) from 5% to 100% by weight of foamable surface-active compounds selected from the group consisting of anionic surface-active compounds of the sulfonate and sulfate types, alkali metal soaps of fatty acids and polyglycol ether non-ionic surface active compounds, where from 50% to 100% by weight of the foamable surface-active compounds are said polyglycol ether non-ionic surface-active compounds and (b) from 0 to 95% by weight of builder salts and cleansing composition additives, said detergent solution being foamed by air to a liter weight of 5 to 30 gm before contacting said soiled textiles, (2) agitating said soiled textiles in the presence of said foamed detergent solution for at least 30 seconds, (3) separating said foamed detergent solution from said textiles under sufficient force whereby the foam is broken and the detergent solution is recovered as a liquor, (4) foaming said recovered detergent solution with air, (5) repeating steps (1) to (4) from five to 50 times, (6) then rinsing said textiles, and (7) recovering cleansed textiles.

2. The method of claim 1 wherein steps (1) to (4) are repeated from 10 to 30 times.

3. The method of claim 1 wherein said separating step (3) is conducted at a force of 5 to 50 times the force of acceleration due to gravity.

4. The method of claim 1 wherein said detergent solution is maintained at a temperature of no higher than the turbidity point temperature of said polyglycol ether non-ionic surface-active compounds.

5. The method of claim 1 wherein said polyglycol ether non-ionic surface-active compounds are selected from the group consisting of alkanols having from 10 to 24 carbon atoms adducted with 3 to 30 ethylene oxide units, alkenols having from 10 to 24 carbon atoms adducted with 3 to 30 ethylene oxide units, alkylphenols having from 6 to 15 carbon atoms in the alkyl adducted with 3 to 30 ethylene oxide units, and mixtures thereof.

6. The method of claim 5 wherein said non-ionic surface active compounds are a mixture of at least one adduct with 3 to 6 ethylene oxide units and at least one adduct with 7 to 20 ethylene oxide units, in a weight ratio of 5:1 to 1:10.

7. The method of claim 1 wherein said detergent solution is filtered before said foaming step (4).

8. The method of claim 1 wherein said detergent solution is replaced at least once during said repeating of said steps (1) to (4).

9. The method of claim 1 wherein, prior to said contacting step (1), said textiles are subjected to a prewash without foam application with a liquor ratio of from 1:5 to 1:20, a cleaning composition concentration of from 1 to 10 gm per liter and a temperature of from 15° C. to 40° C.

10. The method of claim 1 wherein from 0 to 50% of said foamable surface-active compounds are anionic surface-active compounds of the sulfonate or sulfate type and the remainder are said polyglycol ether non-ionic surface-active compounds.

* * * * *